United States Patent [19]

Lindsay

[11] 4,336,427

[45] Jun. 22, 1982

[54] OUTLET ASSEMBLY FOR A VACUUM CLEANING SYSTEM

[75] Inventor: Winston S. Lindsay, Ponca City, Okla.

[73] Assignee: Vacu-Maid, Inc., Ponca City, Okla.

[21] Appl. No.: 193,825

[22] Filed: Oct. 3, 1980

[51] Int. Cl.[3] ..... H01H 27/06

[52] U.S. Cl. ..... 200/61.6; 15/314; 137/360; 339/15

[58] Field of Search ..... 15/314; 137/360, 362; 200/61.6; 251/303; 285/7; 339/15

[56] References Cited

U.S. PATENT DOCUMENTS

| | | | |
|---|---|---|---|
| 2,861,586 | 11/1958 | Dobbs | 137/360 |
| 3,036,170 | 5/1962 | Forney | 200/61.6 |
| 3,036,814 | 5/1962 | Stevens | 251/299 |
| 3,088,484 | 5/1963 | Marsh | 137/360 |
| 3,159,727 | 12/1964 | Boryfewycz | 200/61.6 |
| 3,173,164 | 3/1965 | Congdon | 15/314 |
| 3,291,927 | 12/1966 | Riley et al. | 200/61.6 |
| 3,335,744 | 8/1967 | Hanford | 137/360 |
| 3,483,503 | 12/1969 | Paradiso | 339/15 |
| 3,565,103 | 2/1971 | Maselek | 137/360 |
| 3,661,356 | 5/1972 | Tucker | 137/360 |
| 3,976,068 | 1/1963 | Racklyeft | 200/61.6 |

*Primary Examiner*—Chris K. Moore

*Attorney, Agent, or Firm*—Fishburn, Gold and Litman

[57] ABSTRACT

An outlet assembly for a vacuum cleaning system includes a face plate for mounting on the exterior surface of a building wall, an annular inlet bushing or socket open from the face plate and extending through the building wall and a back plate positioned adjacent the interior surface of the building wall and opposite the face plate and with the inlet bushing extending therethrough. The inlet bushing connects to a vacuum conduit from the vacuum cleaning system for flow of air therethrough. A seal fitting member is positioned generally between the building wall and the back plate and sleeved about the inlet bushing. A resilient seal therein engages the outer surface of the inlet bushing in air-tight relationship and a flange portion engages with the open end of the vacuum conduit and secures the vacuum conduit to the inlet bushing. The back plate has opposite sides with spaced flange portions extending perpendicularly therefrom and during emplacement of the outlet assembly in a building wall, the back plate is reversible to position the end of the vacuum conduit either closely against the wall or spaced therefrom a distance to accommodate variations in building wall thickness.

9 Claims, 7 Drawing Figures

OUTLET ASSEMBLY FOR A VACUUM CLEANING SYSTEM

This invention relates to vacuum cleaning systems having an exhaust blower and receptacle in which dust and other litter is collected when the apparatus is in operation. The blower and receptacle are usually located in a basement or other remote area and several main and branch lines or vacuum conduits extend throughout the building and lead to hose connecting stations or fittings in each of several rooms for connection to a hose of a suction cleaning device. The invention more particularly relates to an outlet assembly such as wall or floor fittings, such wall or floor fittings being relatively easily and securely mounted in the wall or floor to reduce assembly times and lessen any tendency of air leakage between the fittings and the vacuum conduit.

A continuing problem with the installation of wall outlet fittings has concerned the size of the vacuum conduits, normally two inches, relative the transverse interior dimension of the wall into which the conduit is positioned. Some buildings have interior walls with little interior, transverse separation, or thin wall construction, and do not provide sufficient room to position the vacuum conduit in a sufficiently spaced relationship to both interior surfaces of the wall.

Moreover, there must be an air-tight relationship established between an inlet bushing or socket of the outlet assembly and an open end of the vacuum conduit. Frequently, installers do not accurately position seals therebetween and the seals can become loose during usage, thereby resulting in leakage which degrades the efficiency of the vacuum cleaning system.

The principal objects of the present invention are: to provide an outlet assembly that eliminates the aforementioned difficulties; to provide an outlet assembly for vacuum cleaning systems in the form of inlet bushings or sockets, a number of which may be mounted in the walls of the building and connected by vacuum conduits to a central suction apparatus and a cleaner hose and fitting or jack which cooperates with the outlet assembly to connect a vacuum cleaner to said conduits; to provide such an outlet assembly which is closed except when a vacuum cleaner is connected therethrough so that loss of suction will not occur through any outlet assembly when not in use or unattended and that is open when a vacuum cleaning hose fitting is operably associated therewith; to provide such an outlet assembly with electrical terminals which are automatically connected in a control circuit for operation of a suction blower motor when the hose is connected therewith and is in circuit interupting position when the hose is disconnected; to provide an outlet assembly with a seal fitting member which is positioned generally between the building wall and the back plate and sleeved about the inlet bushing in airtight relationship and connectable to the end of the vacuum conduit; to provide such an outlet assembly having a back plate which is reversible to control the distance between the vacuum conduit and the face plate; and to provide such an outlet assembly which is relatively inexpensive, sturdy and efficient in use and particularly well adapted for its intended purpose.

Other objects and advantages of this invention will become apparent from the following description taken in connection with the accompanying drawings wherein is set forth, by way of illustration and example, a certain embodiment of this invention.

Figure 1:
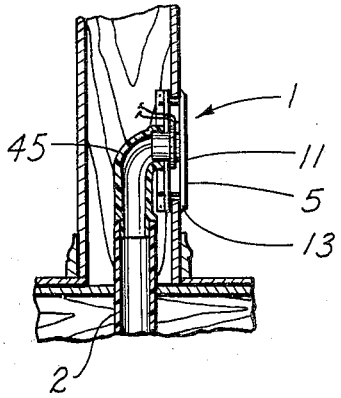
FIG. 1 is a vertical sectional view through an outlet assembly embodying the present invention and with a suction conduit positioned within the wall of a room.

As required, a detailed embodiment of the present invention is disclosed herein, however, it is to be understood that the disclosed embodiment is merely exemplary of the invention which may be embodied in various forms, therefore, specific structural and fuctional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally indicates an outlet fitting embodying the present invention. The outlet fitting 1 is for a vacuum cleaning system including a vacuum conduit 2 extending into the wall 3 of a building. One end of the vacuum conduit 2 is connected to the outlet fitting 1 and the remaining ends leads to a suction fan or pump and an electrical motor (not shown) for driving the vacuum and with electrical connections leading from the motor to a relay switch or control 4 operably connected to the outlet fitting 1 whereby operation of the suction apparatus motor is controlled from the outlet assembly. The outlet fitting 1 includes a face plate 5 with an inlet bushing or socket 6 extending therethrough and connectable to the vacuum conduit 2. The inlet bushing 6 extends through a back plate 7 which is reversible to position the vacuum conduit 2 closer or farther away from the interior surface of the building wall as desired. A seal fitting member 8 is generally positioned between the inlet bushing 6 and the back plate 7 and includes a resilient seal in air-tight engagement with the exterior surface of the inlet bushing 6 and a flange portion for securing to the vacuum conduit 2 for passage of air from the outlet fitting 1 through the vacuum conduit 2.

As used herein, the term "wall" is broadly construed to include both upright partitions within a building, as is the normal usage of the term, and other structural surfaces of the building such as floors, ceilings, and the like. It will be apparent that the outlet fitting 1 can be readily positioned in a floor and installation therein may be preferred in some instances where a building has a large expanse of floor surface without wall surfaces within the reach of common lengths of vacuum cleaning hoses.

In the illustrated example, the face plate 5 of the outlet assembly 1 is preferably formed of sheet metal or the like and includes a wall portion 11 spaced from the exterior surface 12 of the building wall 3 and having an inwardly turned peripheral flange 13 adapted to engage said surface 12. The central portion of the wall portion 11 is inset, as at 14, to provide a recessed wall portion 15 with an opening 16 through which the inlet bushing 6 extends. The recessed wall portion 15 at the opening 16 is suitably secured to the inlet bushing 6 by staking or the like. The outer end 17 of the bushing 6 extends outwardly beyond the recessed wall portion 15, FIGS. 2 and 7, and terminates in an edge adapted to be sealingly engaged by a closure member or cover 19. The inner end 18 of the bushing 6 extends inwardly of the face plate 5 and terminates in an end adapted to be received within an end of the vacuum conduit 2.

Figure 2:
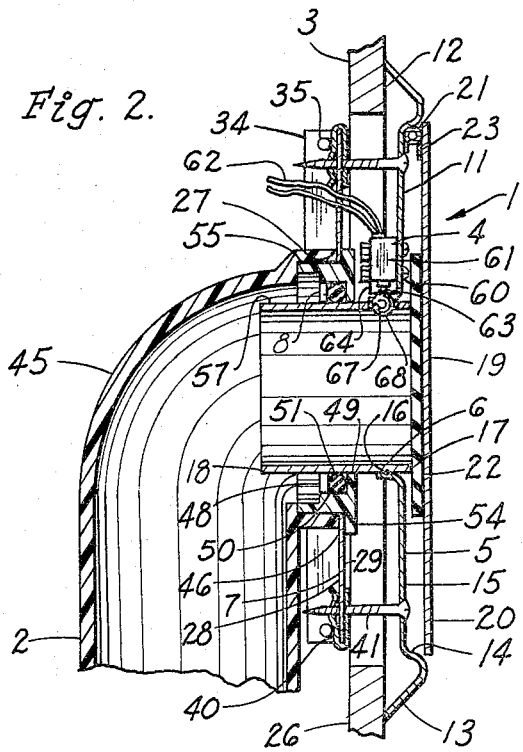
FIG. 2 is an enlarged, vertical, sectional view through the outlet assembly with a closure thereof in closed position.
Figure 7:
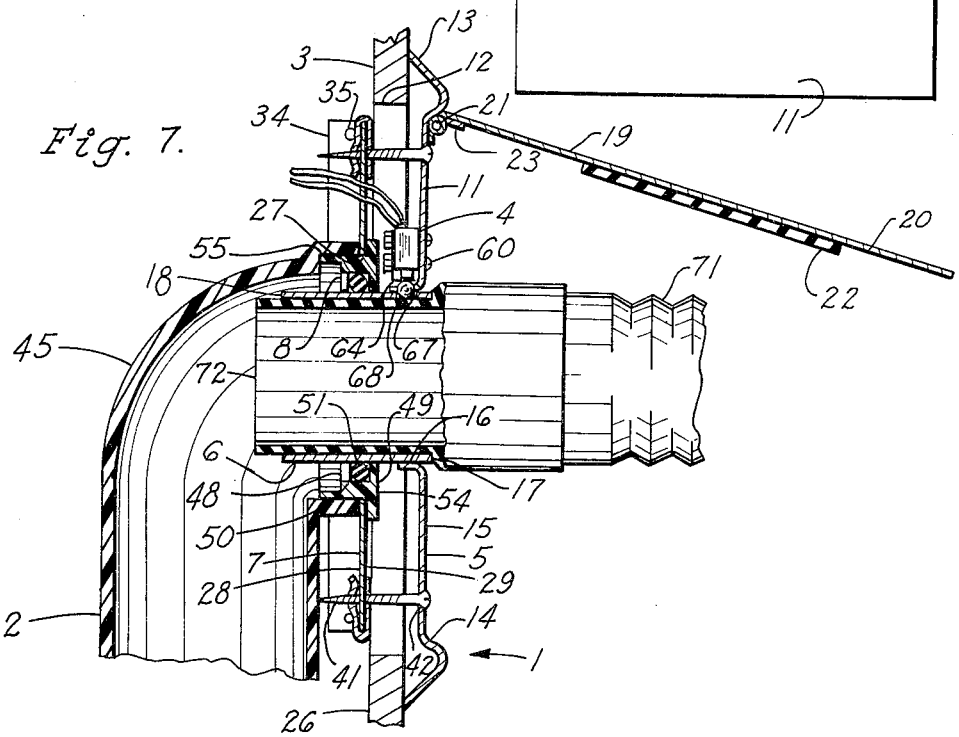
FIG. 7 is an enlarged, vertical, sectional view through the outlet assembly with a suction hose connected therewith.

The cover 19 preferably consists of a door plate 20 swingably mounted on a hinge means 21 secured at an offset relation to the inlet bushing 6 as, for example, above said bushing, FIGS. 2 and 7. The cover door plate 20 has a resilient gasket or disc 22 secured to the inner face thereof as by adhesive or the like whereby when the cover 19 is swung to a closed position the gasket or disc 22 engages the end edge 17 of the inlet bushing 6 to provide a tight joint. A suitable spring 23 is preferably arranged at the hinge means 21 and engaged with the face plate 5 and the door plate 20 to bias the cover 19 towards a closed position at the outer end 17 of the inlet bushing 6.

The back plate 7 is preferably arranged adjacent the opposite or interior surface 26 of the wall 3 from the face plate 5 and has a central aperture 27 slightly larger than the outer diameter of the inlet bushing 6 whereby the bushing extends through the aperture. Portions of the seal fitting member 8 are generally positioned between the interior surface 26 of the wall 3 and the back plate 7 and the seal fitting member is sleeved about the inlet bushing 6 for an air-tight fit between the inlet bushing 6 and the back plate 7. The back plate 7 has opposite surfaces 28 and 29 and opposite sides 30 and 31, said sides respectively having flanges 32 and 33 extending outwardly therefrom generally orthogonally to one of the surfaces 28 or 29, such as the surface 28, and terminating in edges 34 spaced from said surface 28.

Figure 3:
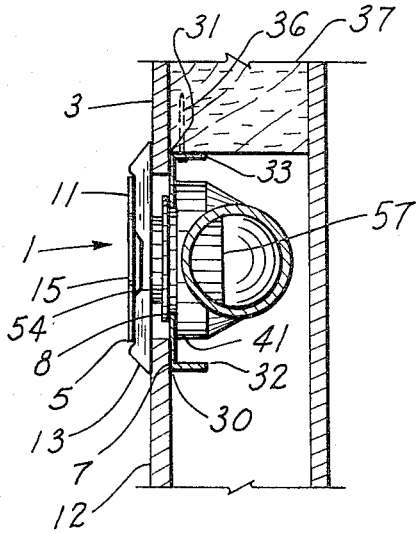
FIG. 3 is a bottom plan view of the outlet assembly within the wall of a building having thin interior wall construction.
Figure 5:
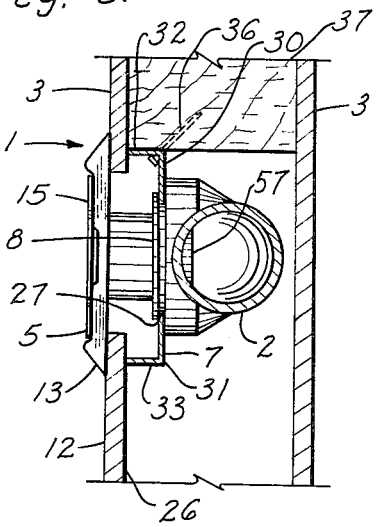
FIG. 5 is a bottom plan view of an outlet assembly within the wall of a building having normal thickness interior wall construction.
Figure 6:
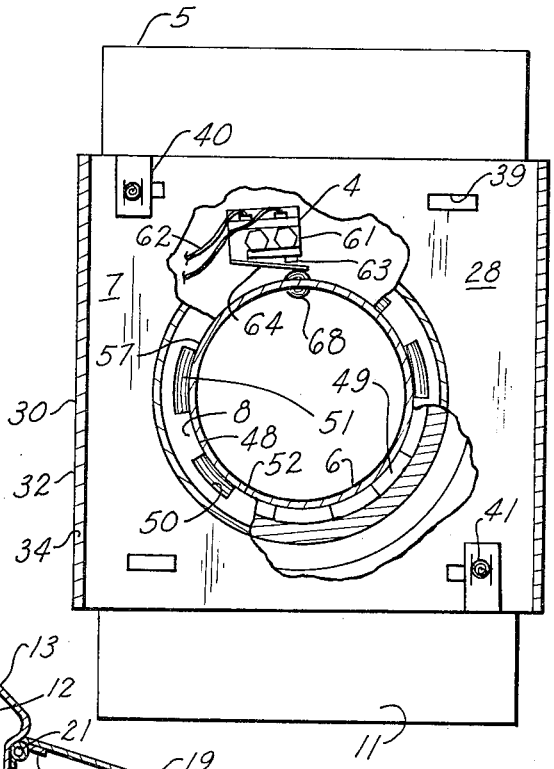
FIG. 6 is an enlarged, fragmentary elevational view of the outlet assembly and showing details of the seal fitting member and an electrical switch means.

The flanges 32 and 33 have holes 35 therethrough for passage of a fastener such as a nail 36 for securing the flange 32 or 33 against an interior wall member such as a stud 37, FIGS. 3 and 5. Apertures 39, FIG. 6, are placed at all four corners of the back plate 7 for securing the back plate 7 to the face plate 5. In the illustrated example, easily movable and self-positioning Tinnerman nuts 40 are provided at diagonally spaced apertures 39 and connect the back plate 7 to the face plate 5 by screws 41. The screws 41 extend through the face plate at 42 and the Tinnerman nuts 40 are easily positionable to clip over various pairs of the apertures 39 and permit reversing of the back plate 7.

The back plate 7 is reversible to place the surface 29 against the interior surface 26 of the wall 3 with the flanges 32 and 33 extending away therefrom, FIG. 3, or reversible to place the surface 28 toward the interior surface of the wall 3 with the edges 34 of the flanges 32 and 33 engaging the interior surface 26. Accordingly, the screws 41 are preferably sufficiently long to extend from the face plate 5 through the back plate 7 regardless of the position of the flanges 32 and 33, FIGS. 3 and 5.

Many recently constructed buildings are of thin wall construction, FIG. 3, having thin paneling or wall board or relatively narrow studs 37 placing the walls 3 of a double wall construction partition in close transverse proximity to each other, for example two inches. When thin wall construction is encountered, the back plate 7 is positioned so that the surface 29 is against the interior wall surface 26 and the flanges 32 and 33 extend outwardly therefrom. Further, allowance for normal or thin walls can be made by providing different lengths, for example, $1\frac{1}{2}$ inches, of bushing 57. Preferably, narrow wall thickness construction is not encountered and the studs 37, FIG. 5, have the normal dimensions of two-by-four lumber, that is $3\frac{1}{2}$ inches width. For normal wall thickness construction, the back plate 7 may be used in either of the orientations shown in FIGS. 3 and 5 and, if desired, used in the orientation shown in FIG. 5, reversed from the orientation shown in FIG. 3, so that the edges 34 of the flanges 32 and 33 engage the interior surface 26 and hold the vacuum conduit 2 a distance greater from the wall 3 than the distance shown in connection with FIG. 3. This provides a space so that fasteners, such as nails, driven through the wall 3, generally do not punch through the wall of the vacuum conduit 2 or so that face plates of longer dimension do not have to be provided to provide greater fastener spacing.

Figure 4:
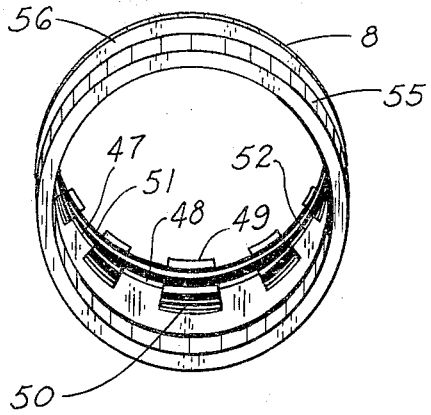
FIG. 4 is an enlarged perspective view of a seal fitting member employed in the outlet assembly.

In the illustrated example, the vacuum conduit 2 has an end fitting or elbow 45 having an open end 46. The seal fitting member 8, FIG. 4, is preferably annular in shape and has an inner grooved portion 47 with spaced wall portions 48 and 49 defining a groove or seat 50 for receipt of a seal 51 such as an O-ring of resilient, synthetic resinous material. The wall portions 48 and 49 each have a plurality of radially inwardly extending fingers 52 separated by recesses 53 and thereby spaced circumferentially around the inner grooved portion 47 and which alternate longitudinally, FIGS. 4 and 6. The fingers 52 alternate in position longitudinally from the wall portion 48 to the wall portion 49 so that one side or the other of the seal 51 at any chosen point is in engagement with a finger 52 and a finger 52 is positioned opposite a recess 53, thereby providing adequate support while retaining flexibility for the seal 51.

In the illustrated example, the inner grooved portion 47 comprises a body portion of the seal fitting member 8 which has an end wall 54 and an outer circumferential flange portion 55 joined to the end wall 54 with a portion of the end wall protruding thereabove and providing a stop 56 contacting the portion of the back plate 7 surrounding the central aperture 27 thereof.

During assembly of the outlet fitting 1, the seal fitting member 8 is sleeved over the inlet bushing or socket 6 so that the seal 51 snugly engages the outer surface 57 of the inlet bushing 6. Then, the back plate 7 is positioned over the inner end 18 of the inlet bushing 6 and the seal fitting member 8 so that the central aperture 27 fits about the circumferential flange portion 55 and areas of the plate surface 28 or 29 adjacent the central aperture the stop 56. Then, the open end 46 of the elbow 45 is sleeved over the outer circumferential flange portion 55 and suitably secured thereto as by gluing or the like, thereby capturing the back plate 7 between the seal fitting member 8 and the elbow 45 while retaining slidable seal means for adjustment both rotatably and longitudinally of the inlet bushing 6 and face plate 5 relative to the wall 3 and back plate 7.

The exemplary outlet fitting 1 has a relay switch means 4 to provide electrical continuity to actuate the vacuum motor and blower. In the illustrated example, the relay switch 4 is affixed to the rear surface of the face plate 5 as by fasteners 60 and has a body 61 containing conventional internal switch circuitry. Electrical lines 62 are operably connected to the internal circuitry of the body 61 and a switch button 63 spring loaded to an extended position protrudes downwardly from the body 61. A spring arm 64 is connected to the body 61 and contacts the switch button. Preferably, the spring arm 64 is formed of a resilient metal biased to a downward position and is movable upwardly by means contacting the end of a vacuum hose, described below, as the vacuum hose is inserted into the inlet bushing 6.

Switch actuation means responsive to the entry of the end of a vacuum hose into the inlet bushing 6 extend through a portion of the wall of the bushing 6 and engages the lower surface of the spring arm 64. In the illustrated example, the inlet bushing 6 has an upper wall with a seat 67 therein in which a ball 68 is received. The seat 67 is of a diameter less than the maximum diameter of the ball 68 whereby the ball is positioned above the bushing 6, prevented from movement downwardly by the size of the seat 67, and resiliently captured above by the spring arm 64.

A suction hose 71 communicating with a vacuum cleaning device (not shown) has a hose end 72 or jack adapted to be inserted into the inlet bushing 6 to communicate the suction hose 71 with the vacuum conduit 2. The hose end 72 is preferably formed of synthetic resinous material such as nylon or other suitable material. When the end 72 is inserted into the inlet bushing 6, the end pushes the ball 68 upwardly which in turn actuates the switch button 63 to energize the switching circuit relay to effect operation of the vacuum motor. The current necessary for the control circuit is preferably of low voltage/amperage so as to present no hazzard from human contact.

With this arrangement, when it is desired to connect the cleaning device to the vacuum cleaning system, the cover 19 is swung outwardly to open the inlet bushing 6 and the hose end 72 is inserted into the bushing 6 until the relay switch 4 is actuated and effects closing of the circuit and energizing of the vacuum cleaning system motor. When the cleaning in the area of the particular station is completed, the hose end 72 is pulled from the outlet fitting 1 and permit the spring arm 64 and ball 68 to move away from the switch button 63, interupting the circuit to the motor from that station. After the hose is removed, the cover 19 swings to the closed position to make a seal with the end of the inlet bushing 6 to prevent loss of vacuum through that assembly in the event of other cleaning devices being used at the same time on the system at that time or used at a later time.

It is to be understood that while one form of this invention has been illustrated and described, it is not to be limited to the specific form or arrangement of parts herein descirbed and shown, except insofar as such limitations are included in the following claims.

What is claimed and desired to secure by Letters Patent is:

1. An outlet assembly for a vacuum cleaning system and comprising:

(a) a back plate having a central aperture and adapted to be positioned generally against the interior surface of a building wall;

(b) an inlet bushing for insertion of a vacuum cleaner hose and having an outer surface and a through bore and extending through said wall and said central aperture in the back plate, and having one open end situated to the interior of said building wall;

(c) a vacuum conduit terminating in an open end adjacent said back plate and aligned with the open end of said inlet bushing; and (d) a seal fitting member engaging said back plate and sleeved abut said inlet bushing, said seal fitting member having an inner seat with a resilient seal therein engaging the outer surface of said inlet bushing in air-tight relationship and a flange portion engaged with said one open end of said inlet housing and connecting said vacuum conduit to said inlet housing.

2. The outlet assembly set forth in claim 1 wherein:

(a) the seat of said seal fitting member includes an inner grooved portion with a plurality of radially inwardly extending fingers forming spaced walls of said groove with said seal captured therebetween.

3. The outlet assembly set forth in claim 2 wherein:

(a) said fingers are circumferentially separated by a plurality of recesses; and (b) said recesses and said fingers alternate around an inner periphery of said seal fitting member on each wall of said groove and each finger is longitudinally aligned with a recess on the opposite wall to provide adequate support and flexibility for said seal.

4. The outlet assembly set forth in claim 2 wherein:

(a) said inlet bushing, the open end of said vacuum conduit and said seal fitting member are transversely annular; and (b) said seal is an annular O-ring.

5. The outlet assembly set forth in claim 1 wherein:

(a) said back plate has a central aperture, opposite surfaces and opposite sides with spaced flange portions extending outwardly from said sides away from one of said surfaces;

(b) said back plate being removably fastened to said face plate and reversible to face either of said opposite surfaces toward the building wall whereby, when said flange portions are directed toward said building wall, said flange portions space said back plate and said vacuum conduit a first distance from said building wall and, when said flange portions are directed away from said building wall, one of said back plate surfaces abuts said building wall and spaces said vacuum conduit a second distance less than said first distance from said building wall.

6. The outlet assembly set forth in claim 1 including:

(a) an electrical switch means associated with said inlet bushing and responsive to insertion of a vacuum cleaner hose in said inlet bushing;

(b) said electrical switch means including a switch body mounted adjacent said inlet bushing and switch actuation means extending into said inlet bushing and movable upon contact with the vacuum cleaner hose, thereby actuating said electrical switch means.

7. An outlet assembly for a vacuum cleaning system and comprising:

(a) a face plate having a central aperture and adapted to be positioned against an exterior surface of a building wall;

(b) an inlet bushing having an outer surface and a through bore and extending through said building wall and having one open end situated to the interior of said building wall;

(c) a back plate having a central aperture, opposite surfaces and opposite sides with at least one flange portion extending generally perpendicularly from at least one of said sides, said inlet bushing extending through said central opening; and (d) a vacuum conduit having an elbow terminating in an open end adjacent said back plate and in sealed connection with the open end of said inlet bushing;

(e) said back plate being removably fastened to said face plate and being reversible to face either of said opposite surfaces toward the building wall whereby, when said flange portion is directed toward said building wall, said flange portion spaces said back plate and said vacuum conduit a first distance from said building wall and, when said flange portion is directed away from said building wall, one of said back plate surfaces abuts said building wall and spaces said vacuum conduit a second distance less than said first distance away from said building wall.

8. An outlet assembly for a vacuum cleaning system comprising:

(a) a face plate having a central aperture and adapted to be positioned against an exterior surface of a building wall;

(b) an inlet bushing having an outer surface, a through bore, and extending through said building wall and having one open end situated to the interior of said building wall;

(c) a back plate having a central aperture and adapted to be positioned adjacent an interior surface of the building wall and opposite the face plate, said inlet bushing extending through the central aperture at said back plate;

(d) a vacuum conduit terminating in an open end adjacent said back plate and in alignment with the open end of said inlet bushing; and (e) a seal fitting member engaging said back plate and sleeved about said inlet bushing, said seal fitting member including an inner seal engaging the outer surface of said inlet bushing in air-tight relationship and a flange portion engaging the open end of said vacuum conduit for passage of air through said vacuum conduit and said inlet bushing.

9. An outlet assembly for a vacuum cleaning system and comprising:

(a) a face plate having a central aperture and adapted to be positioned against an exterior surface of a building wall, said face plate having a cover swingably mounted thereto and biasing means urging said cover to a closed position, said cover having a sealing surface;

(b) an annular inlet bushing having an outer surface and a through bore and extending through said building wall and having one open end situated to the interior of said building wall and a second open end normally closed and sealed by the cover of said face plate;

(c) a back plate with inner rim portions defining a central aperture, opposite surfaces and opposite sides with spaced flange portions extending generally perpendicularly from said sides and from one of said surfaces, said inlet bushing extending through said central aperture of said back plate;

(d) a vacuum conduit having a elbow portion and terminating in an open end adjacent said back plate and in alignment with the open end of said inlet bushing; and (e) an annular seal fitting member engaging said back plate and sleeved about said inlet bushing, said seal fitting member having an annular inner grooved portion with a plurality of alternating recesses and spaced finger portions defining a seal seat and a resilient O-ring seal received therein and engaging the outer surface of said inlet bushing in air-tight relationship, an annular end wall portion providing a stop against inner rim portions defining the central aperture of said back plate and an annular flange portion snugly received within the open end of said vacuum conduit and securing said vacuum conduit to said inlet bushing in air-tight relationship;

(f) said back plate being removably fastened to said face plate and being reversible to face either of said opposite surfaces toward the building wall whereby, when said flange portion is directed toward said building wall, said flange portions space said back plate and said vacuum conduit a first distance from said building wall and, when said flange portion is directed away from said building wall, the opposite of said back plate surfaces abuts said building wall and spaces said vacuum conduit a second distance less than said first distance away from said building wall.

* * * * *

UNITED STATES PATENT AND TRADEMARK OFFICE

CERTIFICATE OF CORRECTION

PATENT NO. : 4,336,427

DATED June 22, 1982

INVENTOR(S) : Winston S. Lindsay

It is certified that error appears in the above—identified patent and that said Letters Patent is hereby corrected as shown below:

In column 6, lines 15, 16 and 17, delete the words "tion engaged with said one open end of said inlet housing and connecting said vacuum conduit to said inlet housing" and substitute the words --tion engaged with said one open end of said vacuum conduit and connecting said vacuum conduit to said inlet bushing.-- therefor.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*